US010321775B2

(12) United States Patent
Jurcenko

(10) Patent No.: US 10,321,775 B2
(45) Date of Patent: Jun. 18, 2019

(54) SIMULATED PLATFORM BED SYSTEM

(71) Applicant: Standard Textile Co., Inc., Cincinnati, OH (US)

(72) Inventor: Jonathan Jurcenko, Fairfield, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 317 days.

(21) Appl. No.: 15/242,974

(22) Filed: Aug. 22, 2016

(65) Prior Publication Data

US 2018/0049558 A1 Feb. 22, 2018

(51) Int. Cl.
*A47G 9/02* (2006.01)
*A47C 19/02* (2006.01)

(52) U.S. Cl.
CPC ..... *A47G 9/0292* (2013.01); *A47C 19/02* (2013.01); *A47C 19/021* (2013.01); *A47C 19/022* (2013.01)

(58) Field of Classification Search
CPC ..... A47C 21/00; A47C 21/022; A47C 21/08; A47C 19/00; A47C 19/02; A47C 19/021; A47C 19/022; A47C 19/024; A47C 19/025; A47C 19/22; A47C 23/05; A47G 9/0292
See application file for complete search history.

(56) References Cited

U.S. PATENT DOCUMENTS 2,671,910 A * 3/1954 Wallen ..... A47C 19/022 403/289
3,768,106 A 10/1973 Fitzgerald et al.
4,106,138 A 8/1978 Murphy
4,364,134 A * 12/1982 Marks ..... A47C 19/021 5/200.1
5,231,717 A 8/1993 Scott et al.
5,802,637 A 9/1998 Bordo
6,035,469 A * 3/2000 Schrougham ..... A47G 9/0292 5/493
6,951,037 B2 * 10/2005 Weinman ..... A47C 20/041 5/200.1

(Continued)

FOREIGN PATENT DOCUMENTS

GB 2031722 A 4/1980
GB 2097665 A 11/1982

OTHER PUBLICATIONS

European Patent Office, Search Report issued in European Patent Application No. 17187212.0 dated Nov. 13, 2017, 5 pages.

*Primary Examiner* — Robert G Santos
*Assistant Examiner* — David R Hare
(74) *Attorney, Agent, or Firm* — Wood Herron & Evans LLP

(57) ABSTRACT

A simulated platform bed system is used with a bed having a mattress and a mattress support, typically provided as a box spring and frame supporting the mattress by a spacing above a floor surface. The system includes an exterior aspect with a decorative feature, as well as a base typically defining a single, continuous piece extending along the side edges and the foot end edge of the bed. At least a portion of the base is made of a plurality of vertically-oriented slats connected together. The slats may be located at corner portions or along an entire length of the system. The system covers the spacing to create the appearance of a platform bed upon which the mattress appears to be supported, even though the weight support of the mattress is through the mattress support rather than the system.

21 Claims, 9 Drawing Sheets

(56) References Cited

U.S. PATENT DOCUMENTS

| | | | | |
|---|---|---|---|---|
| 6,990,698 | B2 * | 1/2006 | Wall, Sr. | A47C 19/005 5/618 |
| 7,845,030 | B1 * | 12/2010 | Pollard | A47C 19/124 5/2.1 |
| 7,865,981 | B2 * | 1/2011 | Harrow | A47C 19/005 5/200.1 |
| 9,044,365 | B2 | 6/2015 | Rawls-Meehan | |
| 9,089,222 | B2 * | 7/2015 | Stewart | A47C 19/025 |
| 9,167,908 | B1 * | 10/2015 | Anthony | A47C 19/02 |
| 2004/0237197 | A1 * | 12/2004 | Cohen | A47G 9/0292 5/493 |
| 2009/0089929 | A1 * | 4/2009 | Hampton | A47G 9/0292 5/493 |
| 2009/0193583 | A1 | 8/2009 | Lee et al. | |
| 2011/0308013 | A1 * | 12/2011 | Kennett | A47C 31/10 5/493 |
| 2015/0000037 | A1 * | 1/2015 | Dalton | A47G 9/0292 5/493 |
| 2015/0327684 | A1 | 11/2015 | Lee | |
| 2015/0359345 | A1 * | 12/2015 | Schulte | A47C 19/005 5/280 |
| 2015/0374148 | A1 * | 12/2015 | Dalton | A47G 9/0292 5/493 |

* cited by examiner

SIMULATED PLATFORM BED SYSTEM

TECHNICAL FIELD

The present invention relates generally to bed furniture and, more specifically, to bed accessories and systems, which provide a specific and desirable aesthetic appearance to bed furniture.

BACKGROUND

Typical beds include a mattress supported above a floor surface by a mattress support. As is widely known, mattresses come in certain sizes, such as twin, full, queen, and king, each having a respective width between side edges and a respective length between the head end edge and the foot end edge thereof. The types of mattress supports available for beds of these different sizes are varied and provide different types of advantages.

One popular type of mattress support is a platform bed. Platform beds have an aesthetic style that is regarded by some as desirable. Platform beds are manufactured by rigidly joining together rigid panels (formed from wood or similar materials) that produce a solid frame on which the mattress is supported, with the panels resting upon and extending upwardly from a floor surface to above the bottom side of the mattress. The panels thus completely surround the mattress along a bottom exterior thereof, while also blocking off access, visually and otherwise, to the area below the mattress. The panels on the side edges of the mattress must have a length corresponding to the length of the mattress, and the panels at the head and/or foot end edges must have a width corresponding to the width of the mattress so that the mattress can be received therebetween. The panels must also be able to support the weight of the mattress and any people and/or things thereon. The exterior aspects of the panels of the platform bed can present an aesthetically desirable appearance as a result of a decorative feature such as wood stain. But platform beds are generally very expensive, thus limiting their availability in many settings. Moreover, platform beds are typically also quite heavy which limits the ability of their owners to move the bed when necessary.

A lower cost option and a more easily transportable mattress support are provided when using a metal bed frame. The metal bed frame is typically characterized by L-shaped side rails that are spaced apart to match the width of the mattress with an exterior portion sitting astride the side edges of the mattress. The side rails are joined by lateral rails to define the bed frame, but the side rails are typically shorter than the length of the mattress so as not to project to or beyond the foot end edge of the mattress supported thereon. The mattress may be placed directly on the frame, or a box spring may be placed on the bed frame with the mattress supported thereon. The mattress is thus supported above the floor surface, but with a much less costly and lighter form of mattress support than that provided by a platform bed. However, these metal bed frames present their own drawbacks. For example, the frame may have legs that rest on the floor surface, but the area below the mattress is otherwise exposed and open. Moreover, the frames themselves, to the extent they present an exterior portion, such as at the side rails, are not particularly desirable to many users or consumers from an aesthetic standpoint.

These deficiencies of the various conventional designs are exacerbated in commercial contexts such as hotels, where both cost effectiveness, in view of the high number of beds that need to be provided, and desirable aesthetics, to entice new and repeat customers, are each highly important aspects when deciding what types of beds and mattress supports to use. Even in personal or home use contexts, it is highly desirable to achieve an attractive aesthetic appearance of a bed without spending an excessive amount of money or significantly limiting possible movements of the bed. Conventional designs like the platform bed and the metal frame bed are not viable options for achieving all of these goals.

The Assignee-Applicant of the present application has therefore developed simulated platform bed systems to help achieve these objectives in a better way than the conventional designs. To this end, one prior design of such a simulated platform bed system, which may be formed from a number of separate panels that are configured to fold up for storage or transport, is described in U.S. Pat. No. 9,089,222.

It would be desirable to provide further alternative and/or improved designs for a simulated platform bed system, which continue to address the various drawbacks of bed designs like the platform bed and the metal frame bed.

SUMMARY

In one embodiment, a simulated platform bed system is provided which provides the appearance of a platform bed without necessitating the high weight, cost, or structure necessary for carrying the weight of a mattress and/or mattress support defining a bed. In this regard, the system includes a base extending in a generally U-shape configuration along first and second side edges and a foot end edge of the bed. At least a portion of the base is defined by a plurality of slats connected together so as to allow relative pivotal movement of adjacent slats. The slats are oriented vertically such that a vertical height defined by each of the slats is greater than a horizontal width or a thickness defined by each of the slats. The slats provide a lightweight construction for the system while also enabling the system to bend around corners of the bed. The system also includes an exterior aspect facing outwardly from the base with respect to the bed, the exterior aspect including a decorative feature. The system is situated about the mattress support such that the system covers at least a portion of a spacing, which is defined between a bottom of the mattress and a floor surface on which the mattress support sits upon, along each of the first and second side edges and the foot end edge of the bed. Accordingly, the system simulates the appearance of a platform bed but it does not support a weight of the mattress. Thus, desirable aesthetic appearance, portability, and low cost (as a result of the use of a metal bed frame or some other similar inexpensive mattress support which is hidden from view by the system) are simultaneously achieved with the system of this design.

In one aspect, the base defines a vertical height equal to or greater than the spacing between the mattress and the floor surface such that the system extends into contact with the floor surface following positioning about the mattress support. The base may further include an upper edge extending along the generally U-shape configuration with a flap portion projecting from this upper edge. The flap portion is configured to tuck between the mattress and the mattress support to retain the system in location relative to the bed. In versions of the system where a fabric layer defines the exterior aspect, this same fabric layer may also define the flap portion. To assist with this securing in position, the flap portion in some embodiments includes coupling elements (hooks or otherwise) configured to engage with at least one of the mattress and the mattress support so as to secure the flap portion and the system in position. The system can alternatively or also include at least one strap member extending between the first and second side edges of the bed to connect the flap portion to itself along the first and second side edges, thereby to further assure retention of the system in position.

In another aspect, the base includes a first corner portion made of a first portion of the plurality of slats and a second corner portion made of a second portion of the plurality of slats. The first corner portion wraps around a first bed corner defined at a junction of the first side edge and the foot end edge, while the second corner portion similarly wraps around a second bed corner defined at a junction of the second side edge and the foot end edge. Each of the first and second corner portions extends along at least portions of the foot end edge and the corresponding side edge on opposite sides of the bed corner. In one example, the first and second corner portions extend at least two inches on the opposite sides of the bed corner to allow for a smooth, curved profile around those bed corners. The plurality of slats in some embodiments defines an entirety of the base so as to have slats along the first and second side edges, the foot end edge, and the first and second corner portions. In other embodiments, a plurality of unitary panels extends between and is coupled to one or both of the first and second corner portions, while also extending along one of the side edges or the foot end edge. Regardless of the particular internal base construction, the system in one embodiment provides the simulated platform bed appearance with a single, continuous piece to define the generally U-shape configuration.

As noted above, the exterior aspect includes a fabric layer in some embodiments. The fabric layer has a pattern or coloring defining the decorative feature, and the fabric layer is bonded to the base along an outward-facing surface of the base which faces away from the mattress support. The fabric layer may be omitted in other embodiments where a wood stain on the slats or some other element is used to define the exterior aspect and the decorative feature. The system also typically includes a backing material bonded to the base along an inward-facing surface of the base. For example, the backing material includes a second fabric layer defined by a different material or decorative pattern than the fabric layer used on the exterior aspect. This second fabric layer may allow the system to be reversible such that different decorative features may be provided in the simulated platform bed system, as the base construction with a plurality of slats can bend around corners regardless of whether the inward-facing surface or the outward-facing surface is directed away from the bed.

Other features may also be provided along an interior aspect of the system which faces inwardly towards the mattress support. To this end, the interior aspect includes in some embodiments loops which are connected to the base along a lower edge thereof. Stabilizing rods may be inserted through the loops to maintain the generally U-shape configuration along the first and second side edges and along the foot end edge of the bed. The interior aspect may also include fastening elements which directly couple the system to the mattress support, such as hook and loop fasteners or bracket-type fasteners, among others. The base may also be spaced from the floor surface when situated about the mattress support in another aspect.

In accordance with another embodiment, a simulated platform bed is defined by a mattress, a mattress support sitting on a floor surface and supporting the mattress by carrying the weight thereof, and a simulated platform bed system positioned around the mattress support. The system includes a base and an exterior aspect as described in detail above, such that the system presents the appearance of a platform bed without carrying the weight of the mattress. Once again, the base of the system is at least partially defined by a plurality of slats. The mattress support includes a box spring and a frame, these elements typically being hidden from view by the simulated platform bed system.

BRIEF DESCRIPTION OF THE DRAWINGS

The accompanying drawings, which are incorporated in and constitute a part of this specification, illustrate embodiments of the invention and, with a detailed description of the embodiments given below, serve to explain the principles of the invention.

DETAILED DESCRIPTION

Figure 1:
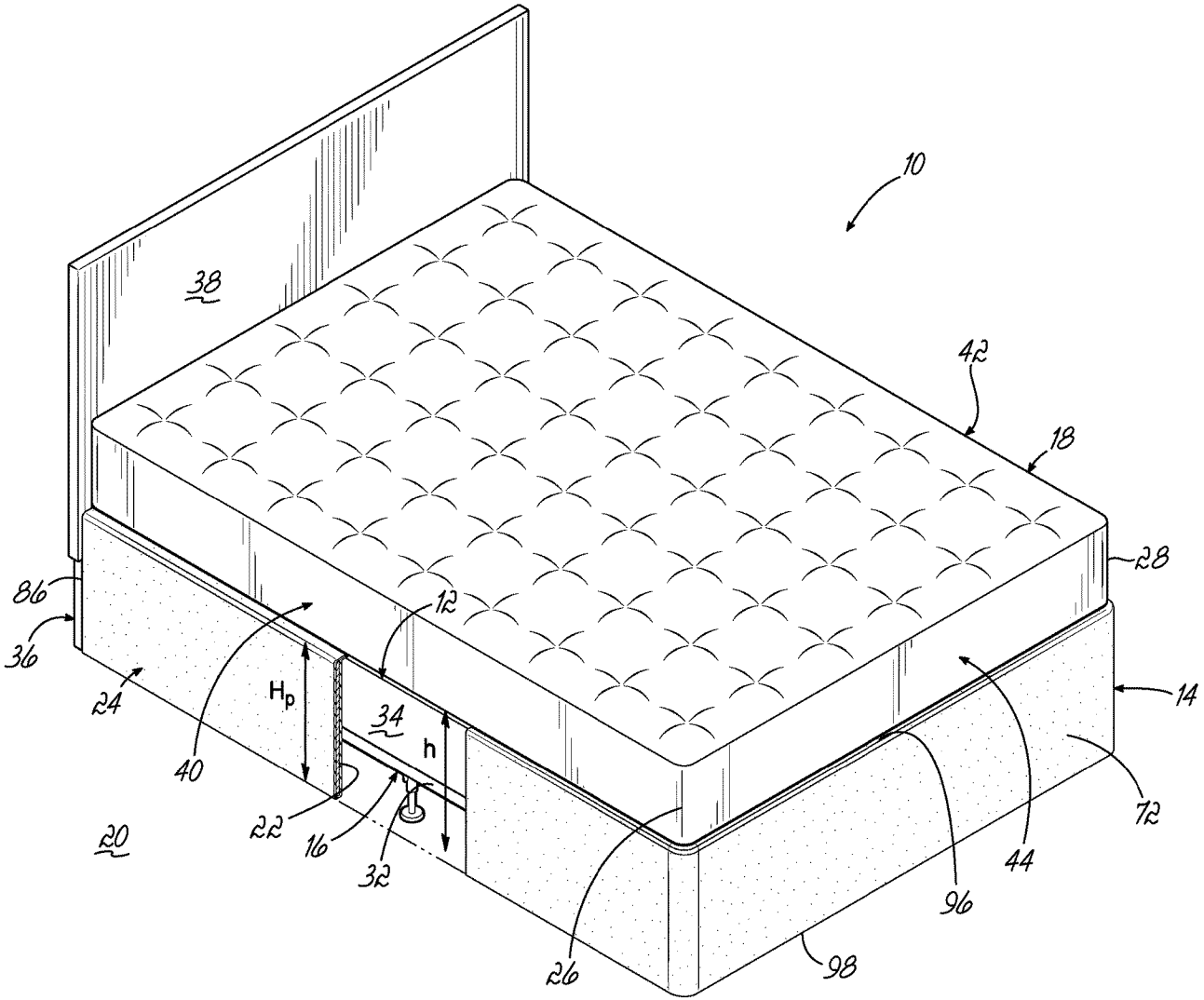
FIG. 1 is a top perspective view of a simulated platform bed which includes a simulated platform bed system in accordance with one embodiment of the invention.

FIGS. 1 through 6 show a simulated platform bed 10 in accordance with one embodiment of the invention. To that end, the simulated platform bed 10 includes a bed 12, which may be of generally conventional construction, and a simulated platform bed system 14 according to the principles of this invention. The bed 12 of the embodiment shown includes a mattress support 16 and a mattress 18, which is supported by the mattress support 16. As described in further detail below, the mattress support 16 includes a simple, metal bed frame 32 and a box spring 34 supported atop the bed frame 32. The mattress support 16 carries the weight of the mattress 18 and positions the mattress 18 above a floor surface 20 by a spacing or first height h as shown in FIG. 1. Regardless of the arrangement chosen for the mattress support 16, the specific aesthetic appearance is not critical because the mattress support 16 is largely or entirely hidden from view thanks to the simulated platform bed system 14, which is situated about the mattress support 16. As such, inexpensive supporting structures such as the simple, metal bed frame 32 may be used to reduce costs and to increase portability of the bed 12, when desired by an end user.

The simulated platform bed system 14 includes a base 22 extending in a generally U-shape configuration around the mattress support 16 and an exterior aspect 24 that faces outwardly from the base 22 with respect to the mattress support 16. As described in further detail below, the base 22 is at least partially defined by a plurality of vertically-oriented slats (not shown in FIG. 1) connected together to allow the base 22 to define a single, continuous piece in this embodiment that bends around first and second corners 26, 28 of the bed 12. The first and second corners 26, 28 of the bed 12, as referred to herein, are collectively defined by corresponding corners on each of the mattress 18, the bed frame 32, and the box spring 34. Therefore, even though the base 22 is positioned specifically about the corners of the bed frame 32 and the box spring 34, for the sake of efficiency, this is generally referred to in this disclosure as having the base 22 bend around or be located about the first and second corners 26, 28. A similar description applies to the edges of the bed 12 as set forth in further detail below.

As will become evident, the simulated platform bed system 14 creates the appearance of a platform bed upon which the mattress 18 appears to be supported. However, it will be appreciated that the mattress 18 is actually supported by the mattress support 16, which is substantially hidden from view by the system 14. Thus, the simulated platform bed 10 defines a desirable aesthetic appearance without necessitating the additional costs and limitations associated with an actual platform bed. Instead, a basic and inexpensive mattress support 16 may be used without negatively impacting the aesthetic design or appearance of the simulated platform bed 10. These and other beneficial features and functionality of the simulated platform bed 10 are described in detail below.

Use of several descriptive terms, such as top, bottom, head, foot, side, horizontal, and/or vertical, for example, as it pertains to/describes the simulated platform bed 10 and its components, is from the viewpoint of how the bed 12 and system 14 are normally oriented after installation as shown in FIG. 1, unless otherwise noted. However, such descriptive terms used in the specification are not to be deemed limiting on the designs of this application unless otherwise recited in the claims.

With continued reference to FIG. 1, the metal bed frame 32 sits on the floor surface 20 in this embodiment, and the box spring 34 defines a foundation supported atop the bed frame 32. It will be appreciated that different types of bed frames and different types of foundations (including, but not limited to, a foam web, slats, or a plywood sheet, etc.) may be used to define the mattress support 16 in other similar embodiments. Likewise, the mattress 18 may be configured to be supported directly on the bed frame 32 without the use of any separate foundation in other embodiments.

Figure 2:
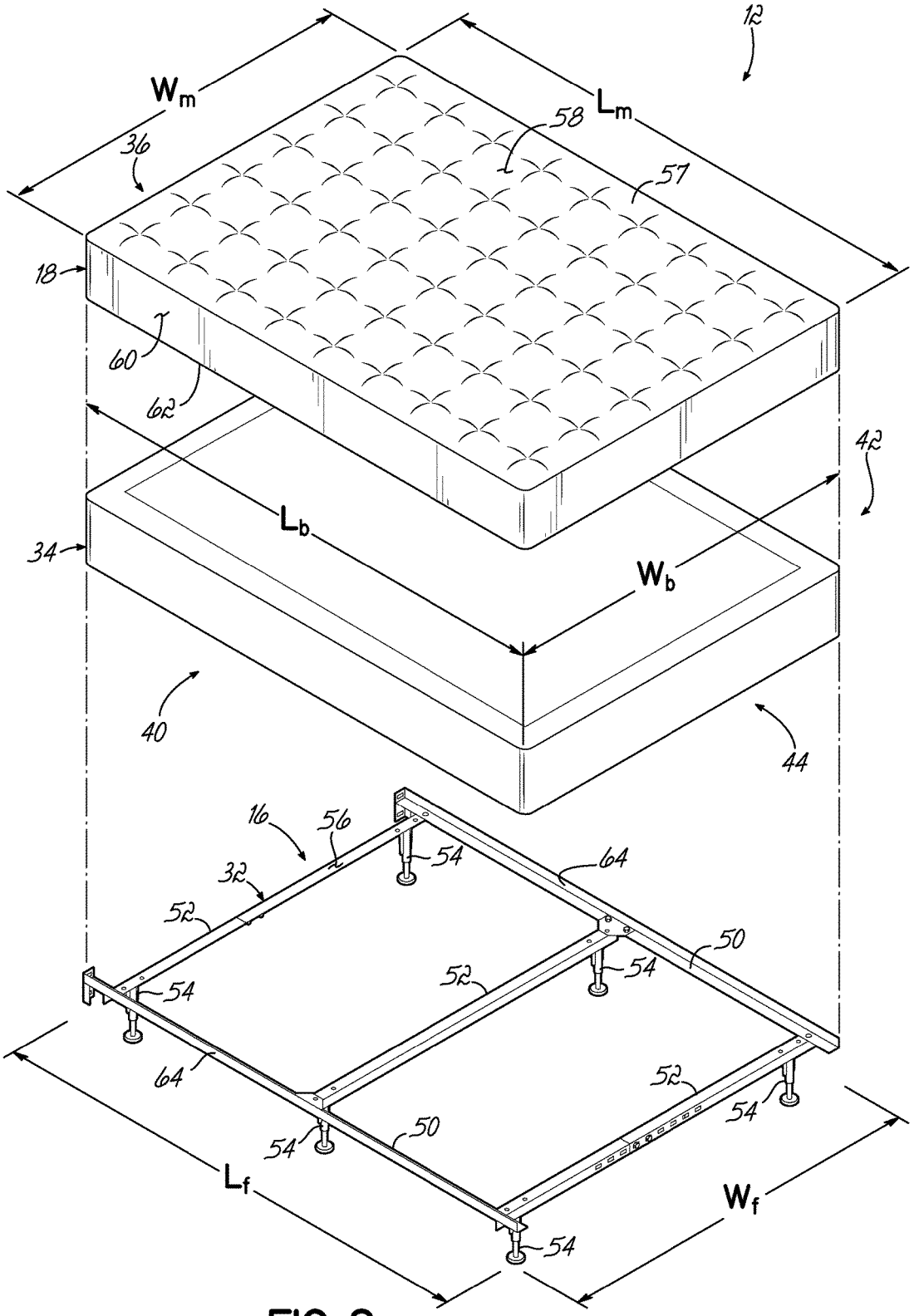
FIG. 2 is an exploded top perspective view of a mattress and a mattress support defining a portion of the simulated platform bed of FIG. 1.

The elements of the bed 12 collectively define a head end edge 36 which may be configured to be positioned adjacent a head board 38. A first side edge 40 and a second side edge 42 of the bed 12 extend from the head end edge 36, and the bed 12 also defines a foot end edge 44 opposite the head end edge 36. These various edges are shown in FIGS. 1 and 2, for example, and the various edges of the bed 12 are defined by corresponding edges on each of the mattress 18, the bed frame 32, and the box spring 34. Therefore, even though the system 14 is positioned specifically along the side edges and foot end edges of the bed frame 32 and the box spring 34, for the sake of efficiency, this is generally referred to in this disclosure as having the system 14 be positioned along the first and second side edges 40, 42 and the foot end edge 44 of the bed 12.

As described in additional detail below, the generally U-shape configuration of the simulated platform bed system 14 arranges this system to extend along each of the first and second side edges 40, 42 as well as the foot end edge 44 when installed as part of the simulated platform bed 10. With the head board 38 normally positioned against a wall surface in most typical bed arrangements, the system 14 is therefore covering some or all of the mattress support 16 at least along the sides or locations where such a mattress support 16 would normally be visible. Consequently, the appearance of a platform bed is achieved in such a state, which is desirable as set forth above.

Further details of the bed 12 and the elements thereof are shown in FIG. 2. The bed frame 32 of this embodiment is a conventional metal bed frame 32 which includes lengthwise-extending L-shaped longitudinal rails 50 and widthwise-extending lateral rails 52. Legs 54 are provided generally near the four corners of the bed frame 32, and for larger mattresses 18 such as queen or king size, may also be provided at additional locations of the bed frame 32 such as along the longitudinal and lateral rails 50, 52. The longitudinal and lateral rails 50, 52 cooperate to define a support surface 56 upon which the box spring 34 (or other similar foundation) is placed with the mattress 18 supported on top of the box spring 34. As is readily understood in the bedding art, the metal bed frame 32 may be configured to be adjustable in size using telescoping portions of the lateral rails 52 and removable connections between all of the longitudinal and lateral rails 50, 52. Nevertheless, the generalized structure and elements of the bed frame 32 described above remain the same regardless of the size of bed 12 that the bed frame 32 is tailored to receive.

The mattress 18 is shown in this embodiment as a conventional mattress and may be any size, such as, for example, twin, full, queen, king, or the like. The mattress 18 is covered in upholstery 57 and includes an upper surface 58, a plurality of sides 60 and a lower surface 62. The mattress 18 defines a length $L_m$ along the sides 60 between the head end edge 36 and the foot end edge 44 and a width $W_m$ in the other direction between the opposed sides 60. The length and width dimensions of the box spring 34 generally match those of the mattress 18 in this embodiment, with the box spring 34 having a length $L_b$ and a width $W_b$.

The metal bed frame 32 is sized and configured to accommodate and support the weight of the box spring 34 and the mattress 18. Particularly, the bed frame 32 has a length $L_f$ extending between the head end edge 36 of the bed 12 and the foot end edge 44 and a width $W_f$. While the length $L_f$ of the bed frame 32 is approximately equal to the length $L_m$ of the mattress 18 in the view shown in FIG. 2, it will be appreciated that the length $L_m$ of the mattress 18 may be slightly greater than the length $L_f$ of the bed frame 32 for larger sizes of mattresses where a portion of the mattress 18 extends slightly beyond the bed frame 32 at the foot end edge 44. Also, while the width $W_f$ of the bed frame 32 is approximately equal as shown in the embodiment of FIG. 2 to the width $W_m$ of the mattress 18, the width $W_f$ of the bed frame 32 may be slightly greater than the width $W_m$ of the mattress 18 to allow exterior aspects or flanges 64 projecting upwardly from the longitudinal rails 50 to extend alongside a portion of the box spring 34 (or mattress 18 if placed directly on bed frame 32). As previously described with respect to FIG. 1, with the legs 54 sitting on the floor surface 20 and the bed 12 fully assembled from the exploded position of FIG. 2, the mattress 18 is supported at the first height h (the "spacing") above the floor surface 20. Normally this would enable persons outside the bed 12 to see the inexpensive metal bed frame 32, but the simulated platform bed system 14 is then added to hide these potentially adverse aesthetics of the mattress support 16.

Now with reference to FIGS. 3 through 6, further details of the simulated platform bed system 14 of this embodiment are shown in detail. Beginning with FIG. 3, the system 14 is shown in its generally U-shape configuration apart from the bed 12. As shown by the partial cutaway along a portion of the system 14 configured to be placed at the foot end edge 44 of the bed 12, the system 14 includes the base 22, which is made up at least partially of vertically-oriented slats 70 connected together. For example, the slats 70 of this embodiment are connected together using tape and/or string (glued to the slats 70) extending across a width of the slats 70 in a generally horizontal direction. The tape and string are not visible in FIG. 3 because these connecting elements are generally positioned on an interior face of the base 22. However, other types of adhering or connecting elements can be used to couple the slats 70 to one another in other embodiments (such as dry web adhesive strips and the like), and the tape and/or string of this embodiment may be repositioned as well without departing from the scope of the invention. The connection of the slats 70 is adapted to enable some pivotal movement of adjacent slats 70 relative to one another, but the plurality of slats 70 collectively define in this embodiment a single, continuous piece for the base 22 when connected together. To this end, the base 22 of the entire system 14 is defined by a generally rigid unitary member in the illustrated embodiments, even though variations are possible in other embodiments.

Figure 3:
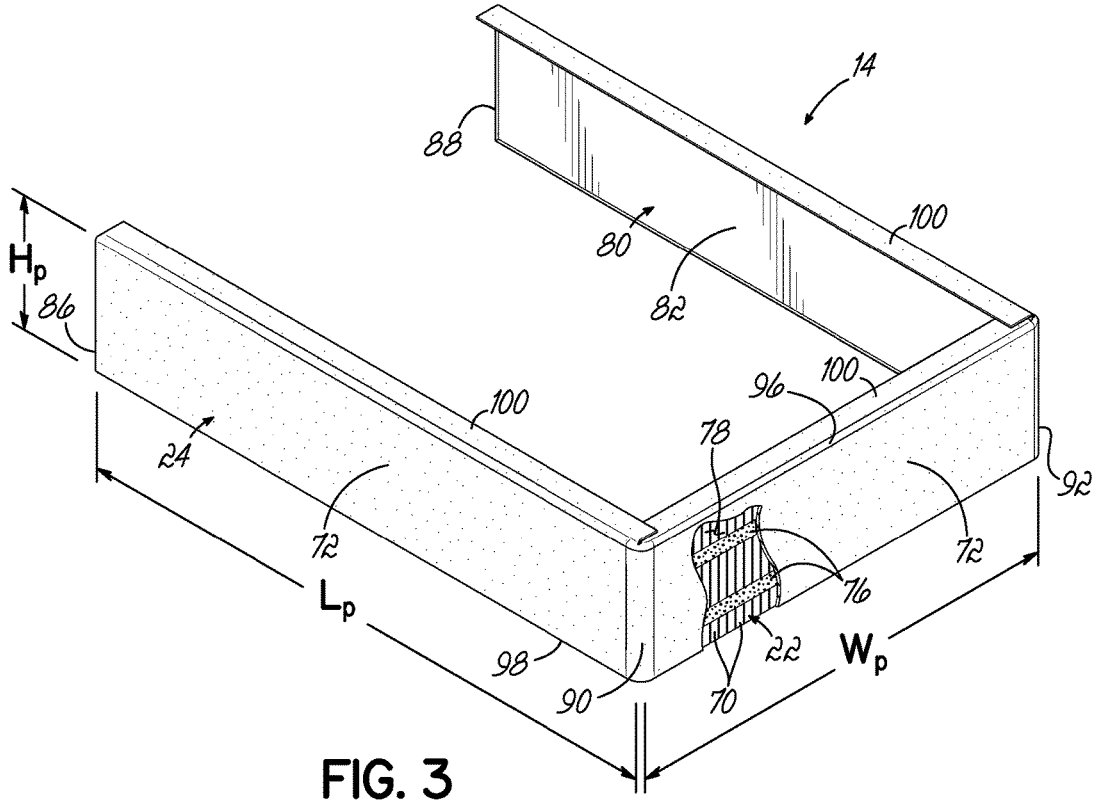
FIG. 3 is a top perspective view of the simulated platform bed system of FIG. 1, with the system shown by itself to reveal additional features thereof, the system being in the U-shape configuration that wraps around the bed when the system is placed around the mattress and mattress support.

The base 22 is covered with an exterior aspect 24, which is defined by a fabric layer 72 in the embodiment shown in FIG. 3. The fabric layer 72 may include a decorative feature 74 such as the coloring or pattern shown in FIG. 4, depending on the preferences of the end user of the system 14. The fabric layer 72 is secured to the base 22 with a dry web adhesive 76 which is visible on the exterior surface 78 of the base 22 revealed at the cutaway portion in FIG. 3. The dry web adhesive 76 is fire retardant and forms a reliable bond to retain the fabric layer 72 in position on the base 22 to define the exterior aspect 24. It will be understood that other types of adhesive materials or other fastening components may be used in other embodiments to secure the fabric layer 72 in position relative to the slats 70.

The fabric layer 72 of this embodiment can be defined by upholstery of various types, including those available commercially from Standard Textile Co., Inc., the original Assignee-Applicant of this application. Of course, the exterior aspect 24 defining the decorative feature 74 can include in other similar embodiments any aesthetically desirable feature, non-limiting examples including various types of upholstery or other fabrics, white vinyl, white faux leather, velvet, or surface finishes applied directly to the slats 70 like paint, stain, textures, sculptures, and the like. The decorative feature 74 of the exterior aspect 24 could also be defined by a plain, untreated version of the exterior surface 78 of the base 22 in other embodiments (providing a plain wooden appearance without the strips of dry web adhesive 76 as shown in the cutaway portion of FIG. 3). When a fabric layer 72 is used at the exterior aspect 24, it will be appreciated that this may be constructed of various conventional materials such as one or more of: natural and/or synthetic fibers, polyester, polypropylene, cotton, etc. The fabric layer 72 also may incorporate additional elements such as, but not limited to: ESD (electrostatic dissipative)/anti-static yarns, including nylon or carbon fibers, and the like; liquid resistant material, such as polyester or polypropylene; liquid resistant coatings or finishes that conform to at least minimum standards established for Level 1 classification by AAMI PB70 Standard, such as a fluorocarbon based finish; and/or an antimicrobial finish. These are but some examples of the materials and options that can be used to provide the exterior aspect 24 of the simulated platform bed system 14.

Figure 4:
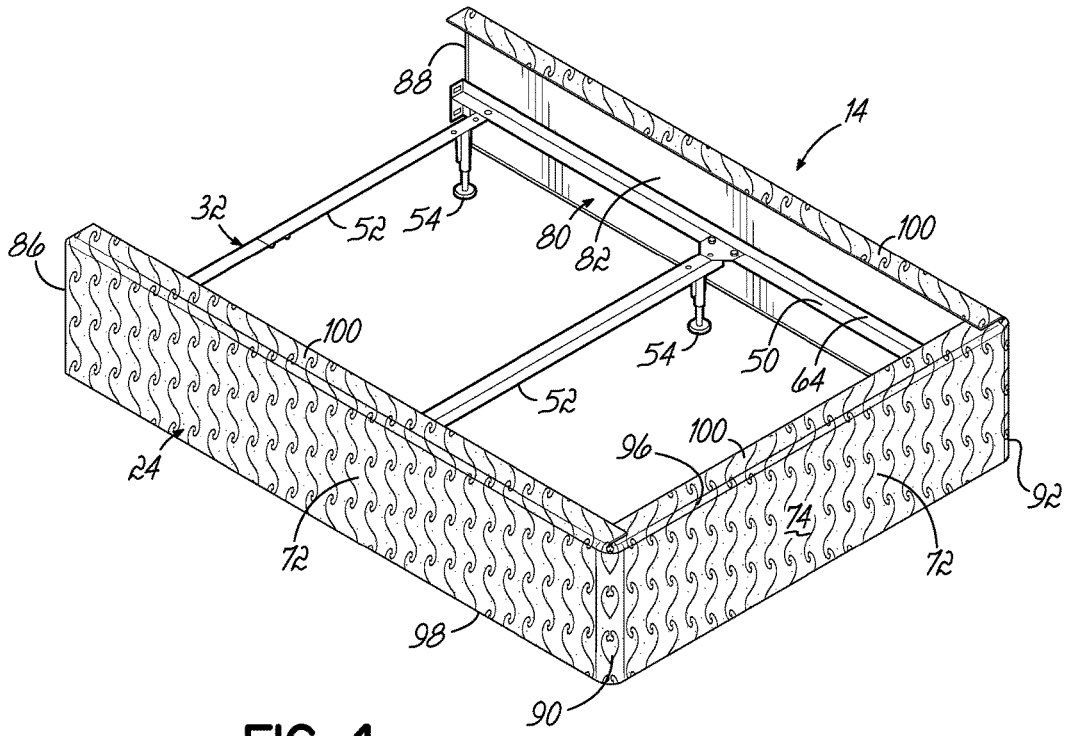
FIG. 4 is a top perspective view of the simulated platform bed system of FIG. 3 in combination with a bed frame defining part of the mattress support of the bed, with a different decorative feature shown on an exterior aspect of the system.

The system 14 also includes an interior aspect 80 located on an opposite side of the base 22 from the exterior aspect 24. To this end, the interior aspect 80 is configured to normally face inwardly towards the mattress support 16 as shown in the configuration of FIGS. 3 and 4. The interior aspect 80 of this embodiment includes a backing material 82 in the form of a second fabric layer which is bonded to the base 22 along the inward-facing inner surface thereof (shown and described below with reference to FIG. 5B). This second fabric layer is typically provided from a different, typically less expensive fabric material than what defines the fabric layer 72 of the exterior aspect 24. The second fabric layer is connected to the slats 70 of the base 22 in a similar manner as described above for the other fabric layer 72, e.g., with strips of dry web adhesive 76 or similar adherence/connecting elements. Of course, the backing material 82 may also be any of the other types of materials such as vinyl, leather, velvet, paint, stain, and the like in other embodiments.

In aspects like the one shown in FIGS. 3 and 4 where the backing material 82 is different than the exterior aspect 24, the backing material 82 may define an alternative aesthetic decorative pattern for the simulated platform bed system 14. In this regard, the connection between the slats 70 of the base 22 may be configured to enable pivoting of adjacent slats 70 in either direction, which means the system 14 could be reversed in orientation with the interior aspect 80 facing outwardly to provide the aesthetic appearance of the platform bed while the exterior aspect 24 faces inwardly towards the mattress support 16. However, such reversible use is not necessary in all embodiments, and the backing material 82 could be omitted or replaced with the same material as the fabric layer 72 in further embodiments consistent with the scope of this invention.

The interior aspect 80 may also include additional optional features as described below to assist with alignment of the generally U-shape configuration along the first and second side edges 40, 42 and the foot end edge 44 of the bed 12, and also to removably connect with the bed 12. These features may render the system 14 non-reversible, however.

In the embodiment of the simulated platform bed system 14 shown in FIGS. 3 and 4, the single, continuous piece defining the base 22 extends from a first terminal end 86 to an opposite second terminal end 88. When wrapped in the generally U-shape configuration around the bed frame 32 as shown, the base 22 and therefore the system 14 extends from the first terminal end 86 along the first side edge 40, then around the first bed corner 26 and along the foot end edge 44, and then around the second bed corner 28 and along the second side edge 42 to the second terminal end 88. In this position, the base 22 includes a first corner portion 90 which is formed from the plurality of slats 70 and is wrapped around the first bed corner 26 to transition smoothly from a generally rectangular-shaped elongated portion of the system 14 at the first side edge 40 to another generally rectangular-shaped elongated portion of the system 14 at the foot end edge 44. Likewise, the base 22 also includes a second corner portion 92 which is formed from the plurality of slats 70 and is wrapped around the second bed corner 28 to transition smoothly from the generally rectangular-shaped elongated portion of the system 14 at the foot end edge 44 to another generally rectangular-shaped elongated portion of the system 14 at the second side edge 42. These smooth transitions at the first and second corner portions 90, 92 improve the aesthetic appearance of the simulated platform bed system 14 while advantageously enabling the continuous or generally unitary construction of the base 22 of the system 14.

As shown most specifically in FIG. 3, the system 14 when in the generally U-shape configuration therefore defines a length $L_p$ along each of the first and second side edges 40, 42 of the bed 12. This length $L_p$ is effectively equal to the length $L_m$ of the mattress 18 (and also the length $L_f$ of the bed frame 32) in this embodiment. The system 14 in this configuration also defines a width $W_p$ along the foot end edge 44 of the bed 12. This width $W_p$ is effectively equal to the width $W_m$ of the mattress 18 (and also the width $W_f$ of the bed frame 32) in this embodiment. To this end, the system 14 serves to cover at least a portion of the spacing between the lower surface 62 of the mattress 18 and the floor surface 20 along effectively the entirety of the first and second side edges 40, 42 as well as the foot end edge 44 of the bed 12. As these are the only portions exposed to be visible when the head board 38 is positioned against a wall of a room, as is typical, the system 14 accurately provides the appearance of a platform bed supporting the mattress 18. It will be understood that the specific dimensions of the system 14 in the final configuration may vary in other embodiments without departing from the scope of this disclosure.

With continued reference to FIG. 3, the base 22 further defines an upper terminal edge 96 and a lower terminal edge 98 for the simulated platform bed system 14, each of which extends along the generally U-shape configuration as shown. In this regard, the upper terminal edge 96 defines a top end of the system 14 when placed around the bed 12, and the lower terminal edge 98 defines a bottom end of the system 14 accordingly. The base 22 is of a consistent height (measured between the upper and lower terminal edges 96, 98) along the entire length between the first and second terminal ends 86, 88, which therefore defines a height $H_p$ of the system 14. For example, if the entirety of the base 22 is defined by the plurality of slats 70, all of the slats 70 define the same vertical height to produce this consistent size of the system 14. In the embodiment shown in FIGS. 1 through 4, this height $H_p$ of the system 14 is a vertical height equal to or greater than the spacing between the mattress 18 and the floor surface 20, previously defined as the first height h. Consequently, this embodiment of the simulated platform bed system 14 is sized such that the lower terminal edge 98 is adjacent to and/or contacts the floor surface 20, thereby covering an entirety of the spacing between the mattress 18 and the floor surface 20. In such embodiments, the appearance of a platform bed is therefore achieved with the system 14 as shown most clearly in FIG. 1. It will be appreciated that the height $H_p$ of the system 14 may be modified in other embodiments, such as one alternative described further below.

The simulated platform bed system 14 further includes a flap portion 100 which projects upwardly from the upper terminal edge 96 of the base 22. The flap portion 100 is shown in a generally vertical position in FIG. 5A and in a generally horizontal orientation (typical in use) in FIGS. 3, 4, and 5B. In this embodiment, the flap portion 100 is defined by one or both of the fabric layer 72 of the exterior aspect 24 and the backing material 82 of the interior aspect 80. This construction is most evident in the edges of FIGS. 5A and 5B, where cross-sections taken through the system 14 are revealed. By forming the flap portion 100 from a fabric layer or multiple fabric layers, the flap portion 100 is flexible and can be pivoted relative to the upper terminal edge 96 of the base 22 to tuck underneath the mattress 18. More specifically, the flap portion 100 is configured to be tucked or inserted between the lower surface 62 of the mattress 18 and the mattress support 16 (in this case, the box spring 34) to retain the system 14 in position in the generally U-shape configuration relative to the bed 12.

In embodiments where the flap portion 100 is configured to help secure the system 14 in position, the system 14 may further include coupling elements 102 such as micro fabric hooks (shown schematically in FIGS. 5A and 5B) similar to elastic bandage wrap hook closures which removably engage with at least one of the lower surface 62 of mattress 18 or the box spring 34. The coupling elements 102, when engaged with these other elements, positively lock or secure the flap portion 100 in the tucked position between the mattress 18 and the mattress support 16, which then also positions the system 14 and the upper terminal edge 96 thereof adjacent to the bottom end of the mattress 18. The coupling elements 102 may be defined by other types of known fasteners configured to engage with fabric materials typically located on mattresses and box springs. Moreover, the coupling elements 102 may be omitted in other embodiments where straps are provided, or when the tucking of the flap portion 100 into position is deemed sufficient to retain the system 14 in the desired position.

Figure 5A:
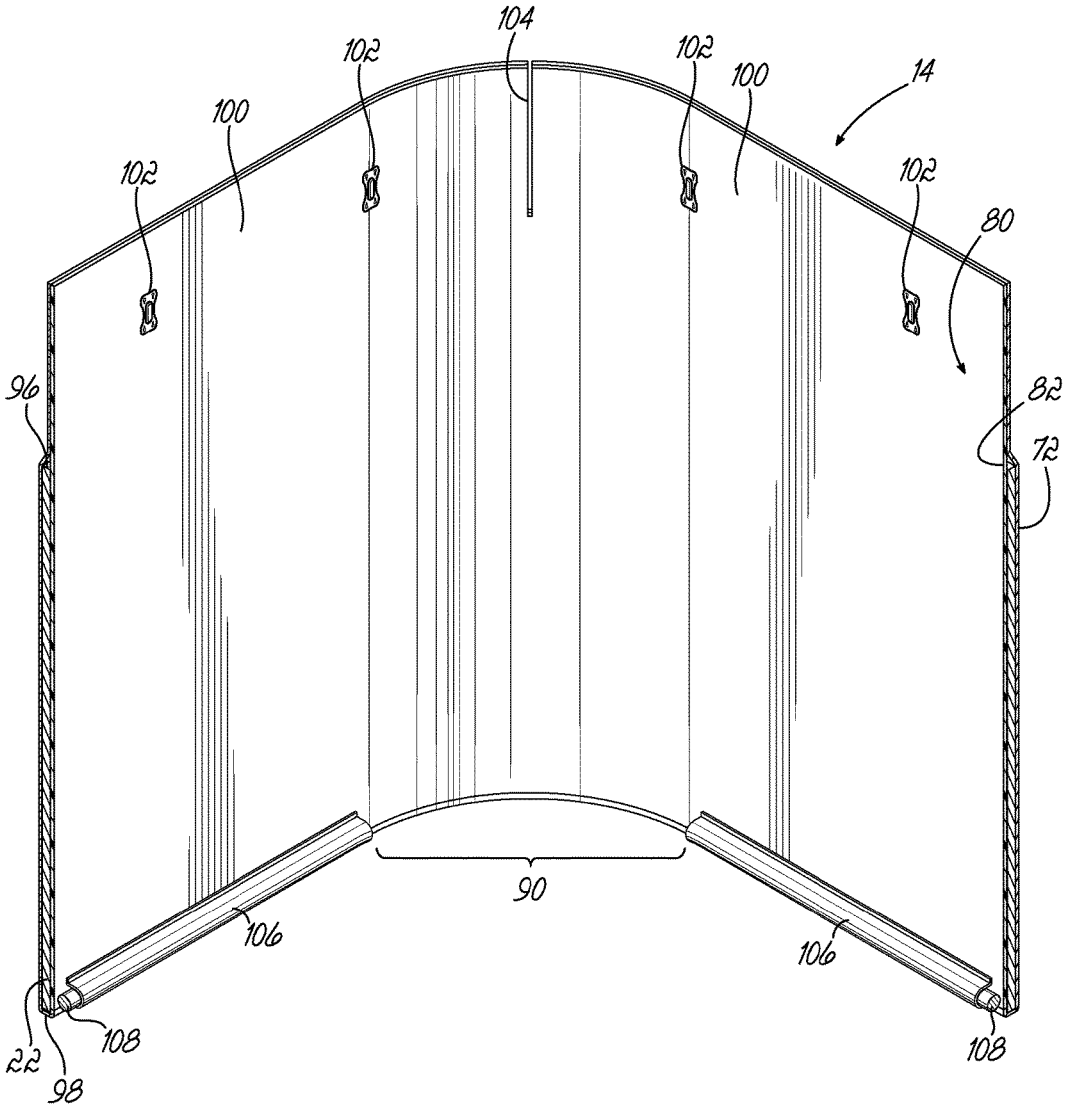
FIG. 5A is an internal perspective view of a cutaway portion of the simulated platform bed system of FIG. 1 that is specifically located about a bed corner when the system is installed, this view revealing additional features along an internal aspect of the system with a flap portion shown in an upright position.

As shown in FIG. 5A, the flap portion 100 may include slits 104 cut through the flap portion 100 adjacent the first and second corner portions 90, 92. These slits 104 allow for the different parts of the flap portion 100 along each of the first and second side edges 40, 42 and the foot end edge 44 to separately and individually fold downwardly to tuck between the mattress 18 and the mattress support 16. If such slits 104 are omitted, the flap portion 100 may bunch up slightly when tucked between the mattress 18 and the mattress support 16 along the first and second corners 26, 28 of the bed 12. However, the flap portion 100 functions similarly in any embodiment to help retain the simulated platform bed system 14 in place relative to the bed 12.

Figure 5B:
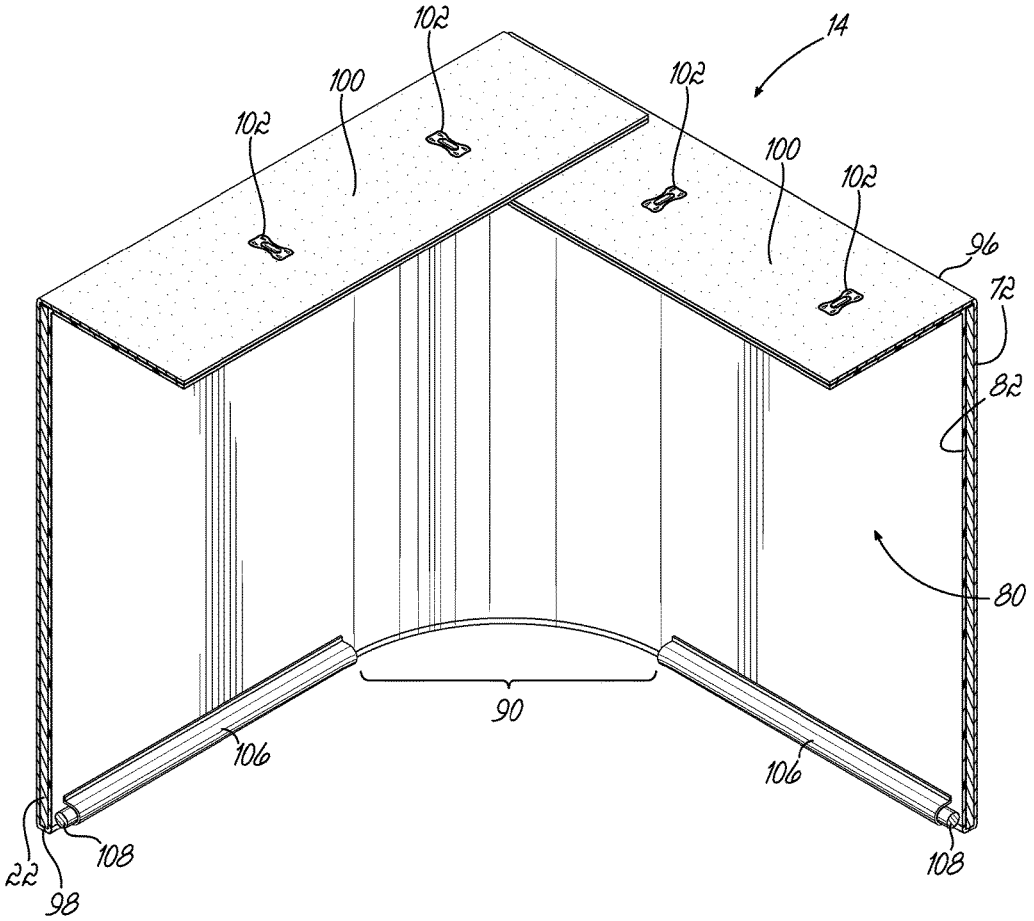
FIG. 5B is an internal perspective view of the cutaway portion of the simulated platform bed system of FIG. 5A, with the flap portion pivoted downwardly to be tucked between the mattress and the mattress support, as is typical during use.

FIGS. 5A and 5B also illustrate another feature of the simulated platform bed system 14 which may be used in some embodiments in accordance with the invention. More particularly, the interior aspect 80 of the system 14 in this embodiment further includes loops 106 of material configured to receive stabilizing rods 108 which are linear members extending along the length of the first and second side edges 40, 42 and the foot end edge 44. The loops 106 in this embodiment are formed from the same fabric as the backing material 82, but it will be appreciated that other types of materials may be used. Likewise, the loops 106 are shown elongated so as to shroud a length of the corresponding stabilizing rod 108 during use, but the loops 106 may be shortened in length and duplicated in multiple places along the interior aspect 80 of the system 14 in other embodiments. The loops 106 are sized to retain the stabilizing rods 108 in close relation to the base 22 along the lower terminal edge 98 (in the illustrated embodiment) and/or at other positions along the height of the system 14. The stabilizing rods 108 therefore abut the plurality of slats 70 defining the base 22 along the first and second side edges 40, 42 and along the foot end edge 44 so as to prevent those elements from pivoting and bending sides of the system 14 inwardly or outwardly in an undesirable manner along these linear edges of the bed 12. The loops 106 and stabilizing rods 108 do not extend along the corner portions 90, 92, which are configured to bend around the first and second bed corners 26, 28. Thus, in embodiments where the loops 106 and stabilizing rods 108 are used, the generally U-shape configuration of the system 14 is further assured during and after installation of the system 14 on the bed 12 with these additional elements. It will be appreciated that the positioning of the loops 106 along the interior aspect 80 may be modified and the loops 106 may be omitted in other embodiments consistent with the scope of this disclosure.

Figure 6:
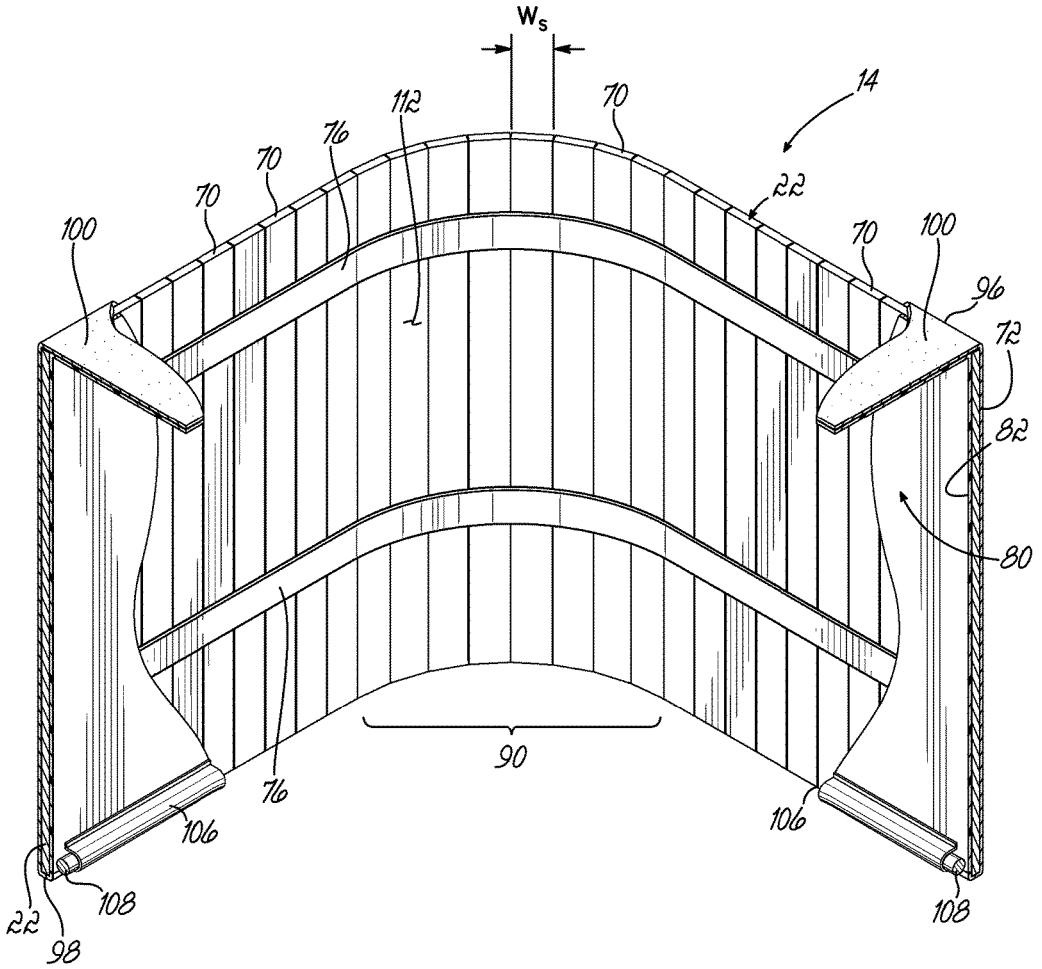
FIG. 6 is an internal perspective view of the cutaway portion of the simulated platform bed system of FIG. 5B, with a backing material cut away to reveal an internal construction of a base of the system with a plurality of slats along the entire length of the base.

FIG. 6 shows the corner portion 90 of this embodiment of the simulated platform bed system 14, but with most of the flap portion 100 and backing material 82 cut away to reveal the internal construction and elements of the base 22. To this end, it can be readily seen in FIG. 6 that the plurality of slats 70 define the base 22 along an entirety of the length of the base 22 between the first and second terminal ends 86, 88. As described above, the slats 70 may be connected together by various means, including but not limited to tape and string, or dry web adhesive 76, strips of which are shown along an interior surface 112 of the base 22. The dry web adhesive 76 in such an embodiment also typically secures the backing material 82, when present, in position along the interior aspect 80. The elements fastening the slats 70 together, whether dry web adhesive 76 or otherwise, may be located on one or both of the exterior surface 78 and the interior surface 112. The plurality of slats 70 collectively define a single, continuous piece for the base 22 and thereby establish rigidity of the base 22 and system 14 while allowing for some bending movement at the first and second corner portions 90, 92 as required. Thus, the slats 70 in this embodiment extend along each of the first and second side edges 40, 42 and the foot end edge 44 of the bed 12.

Each of the slats 70 is vertically oriented as set forth above, such as by defining a vertical height which is much greater than a horizontal width or a thickness of the slats 70. For example, each of the slats 70 defines a horizontal width $W_s$ (measured along the direction of the side edges 40, 42 or the foot end edge 44) of 0.25 inches or 0.5 inches in this embodiment. These are standard sizes for elongated slats 70, and they enable sufficient pivoting movement at the first and second corner portions 90, 92 to remain close to contact with the first and second bed corners 26, 28 when the system 14 is installed in the generally U-shape configuration as described above. In other words, the relatively small width of the slats 70 enables smooth bending around the first and second bed corners 26, 28. However, it will be appreciated that the horizontal width of the slats 70 may be modified to be anywhere within a range of about 0.125 inches to about 2.00 inches in other embodiments consistent with the scope of this invention. By comparison, the vertical height of each of the slats 70 may extend 12 inches or more, depending on the desired height $H_p$ of the system 14.

The plurality of slats 70 is typically formed from wooden slats in the exemplary embodiment, but other materials for the slats 70 may also be used in the base 22. To this end, the slats 70 may also be formed from any of the following: plastics, metals, engineered wood products including oriented strand board (OSB), composites, hardened foam, and combinations thereof. These materials may be provided in solid form or hollow form, depending on the material and the weight of the slats 70 desired. Regardless of materials chosen, the slats 70 are what provides rigidity to the base 22 and the system 14 along the desired locations, to thereby simulate the appearance of a platform bed.

In the embodiment of the simulated platform bed system 14 shown in FIGS. 1 through 6, the plurality of slats 70 defining the base 22 allows the system 14 to retain sufficient rigidity to remain in the generally U-shape configuration while also enabling the corner portions 90, 92 to wrap around junctions of the first and second side edges 40, 42 with the foot end edge 44. As a result, the system 14 covers substantially an entire spacing between the mattress 18 of the bed 12 and the floor surface 20, thereby providing the appearance of a platform bed supporting the mattress 18. In this regard, the system 14 appears from an exterior of the bed 12 to be a single solid piece with rounded corners that supports the mattress 18. However, the system 14 does not carry the weight of the mattress 18, as that functionality is instead provided by the mattress support 16, which in this embodiment is defined by the inexpensive and mobile metal bed frame 32 in combination with a box spring 34. These elements of the mattress support 16 do not have highly desirable aesthetic appearances, but these elements are covered from view by the simulated platform bed system 14. Moreover, the system 14 can be provided with various different types of decorative features 74 on the exterior aspect 24 thereof, such that the system 14 may be configured to provide various different types of desirable aesthetic appearances. Thus, both desirable aesthetic appearance and low cost and portability are simultaneously achieved with the simulated platform bed 10 of this disclosure.

Figure 7:
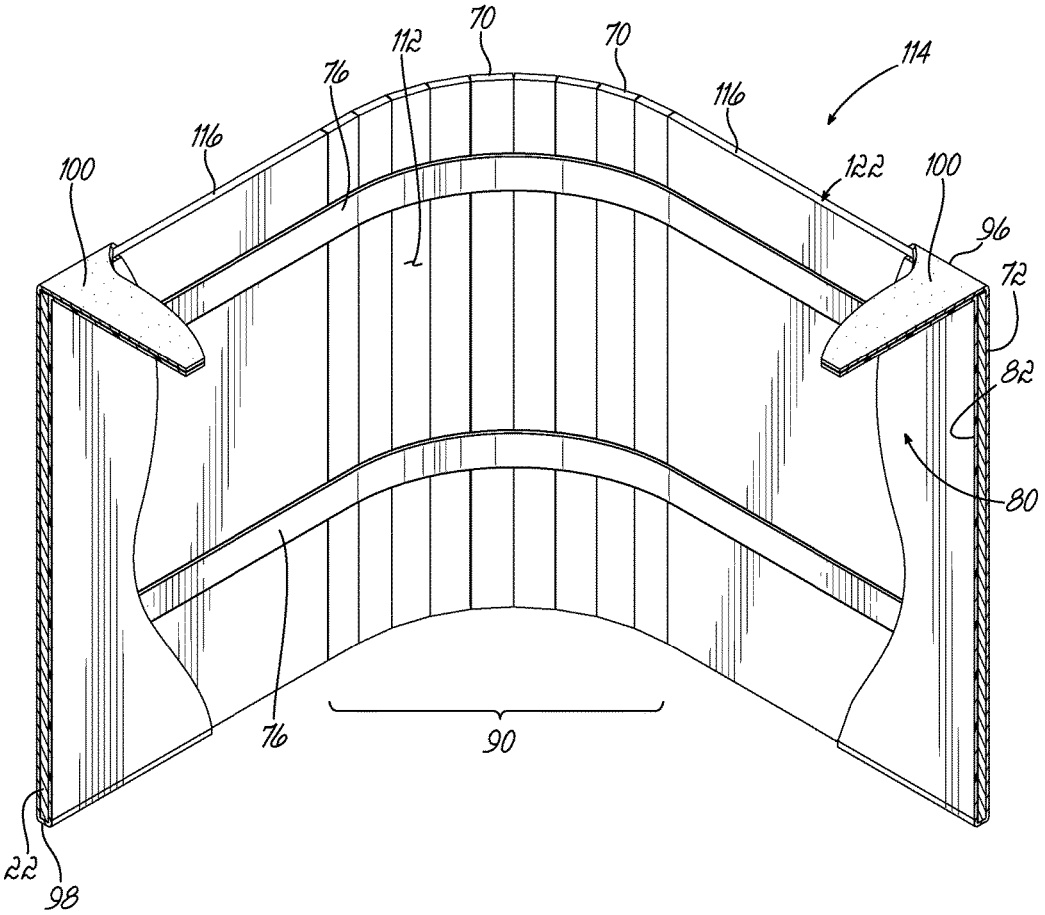
FIG. 7 is an internal perspective view similar to FIG. 6 of a cutaway portion of a simulated platform bed system according to another embodiment of the invention, this embodiment having a plurality of slats at corner portions.

Now turning to FIG. 7, a further embodiment of the simulated platform bed system 114 is shown. Many of the elements of this system 114 are substantially identical to those in the previously-described embodiment(s), and those elements are provided with the same reference numbers without further explanation where they remain unchanged. Just like FIG. 6, this view of the alternative embodiment shows a corner portion 90 of the system 114 with portions of the flap portion 100 and the backing material 82 cut away to reveal interior construction of the base 122. As described below, the base 122 of the system 114 in this embodiment comprises a different arrangement of elements than the prior embodiment.

To this end, the plurality of slats 70 need to be provided at least at the first and second corner portions 90, 92 to enable the smooth bending of the system 114 at the bed corners 26, 28. However, it is possible to replace the slats 70 with an alternative base element or elements along the portions of the system 114 which are intended to remain linear when placed along the first and second side edges 40, 42 and the foot end edge 44. In FIG. 7, these alternative elements are shown as unitary rectangular panels 116, which may be formed from any of the same rigid materials as described above for the slats 70 (and may be defined by solid material, hollow material, or frameworks as well understood in the art). The unitary panels 116 extend along a majority of each of the first and second side edges 40, 42 and the foot end edge 44 when the system 114 is positioned at the bed 12 in the generally U-shape configuration. As the unitary panels 116 are rigid, the loops 106 and stabilizing rods 108 of the previous embodiment may be omitted. The base 122 of this simulated platform bed system 114 functions in exactly the same manner as the prior embodiment, presenting the appearance of a single, continuous piece that extends around the bed 12 and that appears to support the weight of the bed (but actually does not).

The unitary panels 116 may also be defined in further alternative embodiments by other rigid constructions or assemblies such as a plurality of horizontally-oriented slats, for example. So long as the unitary panels 116 are generally rigid and sized to cover at least a portion of the spacing between the mattress 18 and the floor surface 20, these panels 116 can be combined with the slats 70 to define the base 122 in accordance with the advantages and functionalities of this invention. The slats 70 of this embodiment extend along at least portions of the first side edge 40 and the foot end edge 44 on opposite sides of the first bed corner 26 when defining the first corner portion 90, as shown in FIG. 7. It will be appreciated that the slats 70 at the second corner portion 92 also extend along at least portions of the second side edge 42 and the foot end edge 44 on opposite sides of the second bed corner 28. More specifically, the slats 70 extend along at least 2.00 inches or more of the first side edge 40 and the foot end edge 44 at the first corner portion 90, and the slats 70 extend along at least 2.00 inches or more of the second side edge 42 and the foot end edge 44 at the second corner portion 92. Therefore, the plurality of slats 70 in this embodiment define at least 4.00 inches of total coverage, minimum, provided by the base 122. The slats 70 and the unitary panels 116 may be combined in any configuration and at any location along the base 122, so long as the first and second corner portions 90, 92 include the slats 70 to enable the smooth bending of the base 122 and the system 114 around bed corners 26, 28 to provide the platform bed appearance.

Figure 8:
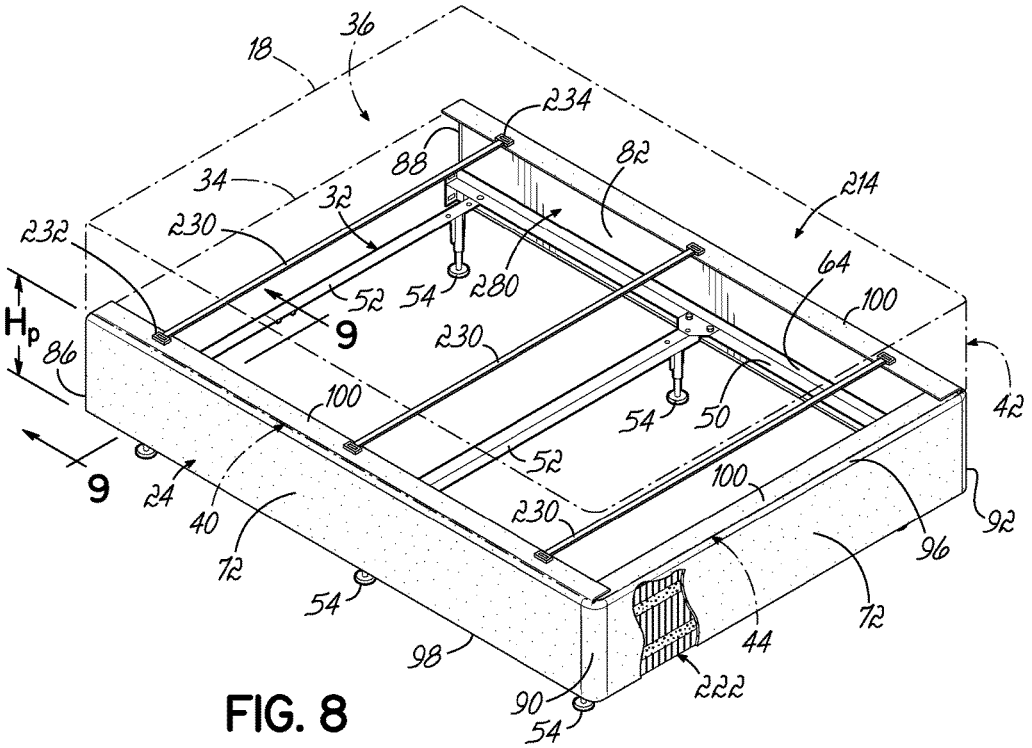
FIG. 8 is a top perspective view of a simulated platform bed in accordance with another embodiment of the invention, the mattress and a box spring being shown in phantom to reveal additional features of the simulated platform bed system used with this embodiment, such as strap members secured with the flap portion and a gap between the bottom of the system and a floor surface.
Figure 9:
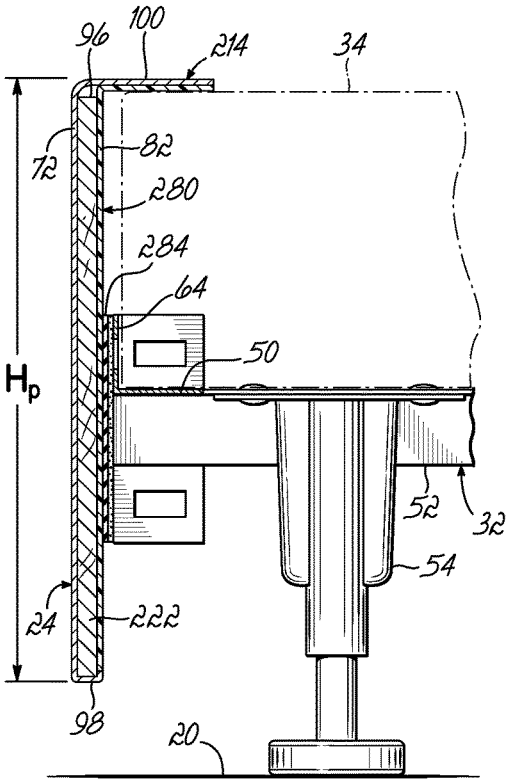
FIG. 9 is a cross-sectional elevation view of the bed frame and the simulated platform bed system of FIG. 8, taken along line 9-9 in FIG. 8, so as to reveal a direct connection between the bed frame and the system using a hook and loop fastener.

Now turning to FIGS. 8 and 9, a further embodiment of the simulated platform bed system 214 is shown. Many of the elements of this system 214 are substantially identical to those in the previously-described embodiment(s), and those elements are provided with the same reference numbers without further explanation where they remain unchanged. The system 214 of this embodiment again includes a base 222 (formed at least partially of slats 70), an exterior aspect 24 providing a decorative feature 74, and a flap portion 100 that is configured to tuck between the mattress 18 (shown in phantom in FIG. 8) and the mattress support 16, specifically the box spring 34 (shown in phantom) on top of the metal bed frame 32. To assure that the flap portion 100 and the remainder of the system 214 are retained in the desired position and the generally U-shape configuration, the system 214 of this embodiment further includes strap members 230 that connect to the portions of the flap portion 100 which extend along the first and second side edges 40, 42 of the bed 12. The strap members 230 connect the flap portion 100 to itself at one or more locations along the length of the bed 12, which prevents movement of the flap portion 100 away from the tucked position between the mattress 18 and the box spring 34. Consequently, the system 214 is retained in the desired position and alignment in this embodiment without necessitating the use of small fabric hooks or similar coupling elements 102 as in previous embodiments.

The strap members 230 may be formed from an elastic material or some other similar material. It will be understood that only one strap member 230 may be provided instead of the multiple strap members 230 shown in FIG. 8, and the specific positioning of the strap members 230 may also be modified without departing from the scope of this invention. The ends 232, 234 of the strap members 230 may be permanently coupled (by stitching or otherwise) to the flap portion 100, or alternatively, one or both ends 232, 234 of the strap members 230 may be removably connected to the flap portion 100.

The simulated platform bed system 214 of this embodiment also differs from previous embodiments in that the height $H_p$ of the system 214 as defined by the base 222 is shorter than the spacing between the mattress 18 and the floor surface 20. To this end, the lower terminal edge 98 defined by the base 222 is spaced in this embodiment from the floor surface 20 after installation of the simulated platform bed system 214 on the bed 12. The gap between the system 214 and the floor surface 20 of this embodiment is most readily visible in the cross-sectional view in FIG. 9. The simulated platform bed system 214 is still sized to cover a majority of the spacing between the mattress 18 and the floor surface 20, and accordingly, the general improved aesthetic appearance is still provided by substantially hiding the elements of the mattress support 16. The exterior aspect 24 of the system 214 is still present to deliver any of the various kinds of decorative features 74 described above. Indeed, if the gap is very small between the system 214 and the floor surface 20, the appearance of a platform bed supporting the mattress 18 may still be provided (even though on closer inspection, the gap may reveal that the system 214 does not actually contact the floor surface 20 or support the weight of the mattress 18). Furthermore, additional panels or other decorative elements may be positioned adjacent the gap in still further alternative embodiments to collectively block visibility of the mattress support 16 with the system 214. Nevertheless, the simulated platform bed system 214 continues to provide the same advantages and functionalities of the prior embodiments even without extending into contact with the floor surface 20.

Another variation of the simulated platform bed system 214 of this embodiment is shown in FIG. 9. The system 214 again defines an interior aspect 280 facing inwardly towards the bed 12, but in this embodiment the interior aspect 280 includes both the backing material 82 and fastening elements 284 for directly coupling the system 214 to the bed frame 32 at various locations along the system 214. In this regard, the flanges 64 of the longitudinal rails 50 on the bed frame 32 (or some other portion of the bed frame 32) are connected to the interior aspect 280 by the fastening elements 284, which in this illustrated embodiment include hook and loop fastener panels (e.g., such as VELCRO®) on each of the bed frame 32 and the interior aspect 280. The coupling provided at the fastening elements 284 in combination with the tucking of the flap portion 100 underneath the mattress 18 is sufficient to retain the simulated platform bed system 214 in the generally U-shape configuration and in the desired position relative to the bed 12. As will be understood, this arrangement means the bed frame 32 and mattress support 16 actually carry and support the weight of the system 214 in this embodiment as well as the weight of the mattress 18, thereby allowing the system 214 to be used without contacting the floor surface 20.

Figure 10:
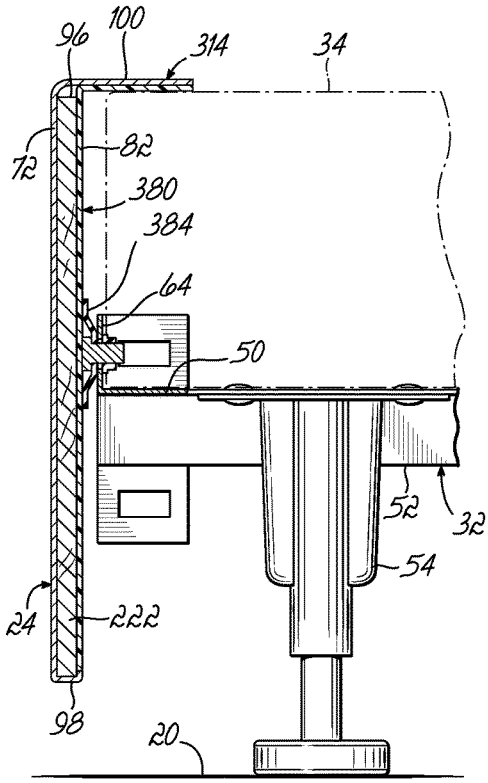
FIG. 10 is a cross-sectional elevation view similar to FIG. 9 of the bed frame and a simulated platform bed system according to another embodiment wherein the direct connection between the bed frame and the system uses a bracket connection.

Although the fastening elements 284 of the system 214 in FIGS. 8 and 9 are hook and loop fastener panels, it will be appreciated that alternative types of fastening elements are possible in other embodiments of the invention. One such example is shown in another alternative embodiment shown in FIG. 10, which shows a cross-section of a simulated platform bed system 314 similar to the view of the prior embodiment at FIG. 9. Once again, many of the elements of this system 314 are substantially identical to those in the previously-described embodiment(s), and those elements are provided with the same reference numbers without further explanation where they remain unchanged. The system 314 of this embodiment includes brackets 384 as the fastening elements located along the interior aspect 380. The brackets 384 may be secured to the rails 50, 52 of the bed frame 32 using known threaded fasteners and the like. Such an embodiment would require more assembly effort than the use of hook and loop fastener panels, but the direct coupling of the system 314 to the bed frame 32 would be more resistant to accidental disconnection or misalignments in this embodiment. It will be understood that still other types of fastening elements could be used to directly couple a simulated platform bed system to a mattress support in other embodiments, including but not limited to snaps, tie elements, and clamping elements. Thus, the simulated platform bed system of the embodiments described above achieves the desirable aesthetic appearance of a platform bed without requiring weight support of the mattress 18 or an assembly of multiple panels or parts, regardless of whether the system is directly coupled to the mattress support or largely self-supported by contact with the floor surface 20.

Figure 11:
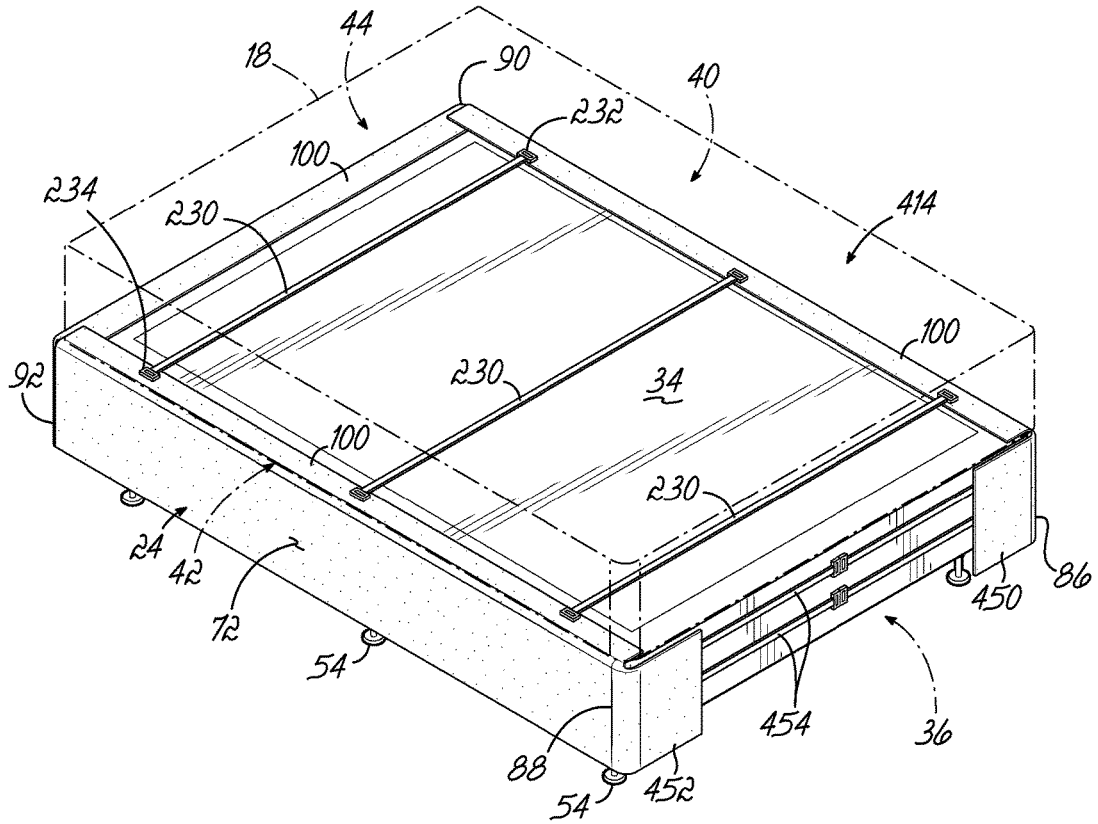
FIG. 11 is a top perspective view of a simulated platform bed in accordance with another embodiment of the invention, the view showing additional simulated platform bed system features that are located along a head end edge of the bed.

Now turning to FIG. 11, a further embodiment of the simulated platform bed system 414 is shown. Many of the elements of this system 414 are substantially identical to those in the previously-described embodiment(s), and those elements are provided with the same reference numbers without further explanation where they remain unchanged. FIG. 11 shows a top perspective view of the system 414 similar to FIG. 8, but from an opposite corner of the bed 12. To this end, the head end edge 36 and the second side edge 42 of the bed 12 are visible in the foreground of this Figure to reveal additional elements included in this embodiment. The system 414 of this embodiment continues to include the base 22 and exterior aspect 24 extending in a generally U-shape configuration along the first and second side edges 40, 42 and the foot end edge 44, along with the flap portion 100 and the (optional) strap members 230 extending across from the flap portion 100 proximate the first side edge 40 to the flap portion 100 proximate the second side edge 42. However, the system 414 of this embodiment also includes portions which wrap around and extend along the head end edge 36 of the bed 12.

To this end, the system 414 includes a first lateral flap portion 450 defined by one or both of the fabric layer 72 of the exterior aspect 24 and the backing material 82 of the interior aspect 80, with the first lateral flap portion 450 extending from the first terminal end 86 (shown schematically for reference in FIG. 11) of the base 22 to thereby wrap around a bed corner defined between the head end edge 36 and the first side edge 40. The first lateral flap portion 450 extends along a partial portion of the head end edge 36 as well. Similarly, the system 414 includes a second lateral flap portion 452 defined by one or both of the fabric layer 72 and the backing material 82. The second lateral flap portion 452 extends from the second terminal end 88 (shown schematically for reference in FIG. 11) of the base 22 to thereby wrap around a bed corner defined between the head end edge 36 and the second side edge 42. The second lateral flap portion 452 also extends along a partial portion of the head end edge 36, in a direction towards the first lateral flap portion 450. The first and second lateral flap portions 450, 452 are connected to one another by one or more head end strap members 454 (two shown in FIG. 11) connected to and extending between the first and second lateral flap portions 450, 452. These head end strap members 454 may be formed from an elastic strap or the like, and they are positioned along the head end edge 36, and specifically at the box spring 34, to help retain the system 414 in position relative to the mattress support 16. In this regard, the head end strap members 454 function in a similar manner as the strap members 230 connecting parts of the flap portion 100 together as described above, although it will be understood that such other strap members 230 may be omitted when the head end strap members 454 are provided.

In addition to assisting with securing the system 414 in the generally U-shape configuration (defined as such in view of the base 22 being entirely or almost entirely in the U-shape when positioned about the bed 12), the first and second lateral flap portions 450, 452 also help cover the mattress support 16 from view at the corners located adjacent the head end edge 36 and the head board 38 (when provided). Even when the head end edge 36 of the bed 12 is located adjacent a wall of a room, as is typical, these corners may still be visible but for the provision of the first and second lateral flap portions 450, 452. Thus, these elements enhance the simulated appearance of the platform bed. The head end strap members 454 are located sufficiently inward from the corners so as to not be visible when the bed 12 is placed with the head end edge 36 against a wall of a room. Consequently, the head end strap members 454 do not negatively impact the aesthetic appearance of the bed 12 using the system 414.

It will be understood that the additional features of the system 414 shown in FIG. 11 can be combined with the other embodiments described above to enhance the appearance or reliable positioning of the elements described herein. Moreover, in other embodiments consistent with the invention, the slats 70 defining the base 22 may also be configured to extend within the first and second lateral flap portions 450, 452 without departing from the scope of this disclosure. As noted above, the substantial majority of the base 22 still defines a generally U-shape configuration in such alternative embodiments. The specific configuration and size of the elements of the system 414 shown at the head end edge 36 in FIG. 11 can be modified as needed to suit the needs of the end customer.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. For example, the features described in connection with one embodiment of the system may be equally applied with features from another embodiment of the system. Thus, the invention in its broader aspects is therefore not limited to the specific details, representative apparatus and method and illustrative example shown and described. Accordingly, departures may be made from such details without departing from the spirit or scope of applicant's general inventive concept.

What is claimed is:

1. A simulated platform bed system for use with a bed including a mattress and a mattress support configured to support the mattress at a first height above a floor surface, the first height defining a spacing between the mattress and the floor surface, and the system comprising:

a base extending in a generally U-shape configuration along first and second side edges and a foot end edge of the bed, at least a portion of the base being defined by a plurality of slats connected together and oriented vertically such that a vertical height defined by each of the slats is greater than both of a horizontal width and a thickness defined by each of the slats, wherein the thickness of each slat is measured along a horizontal direction perpendicular to a direction defining the horizontal width and perpendicular to a direction defining the vertical height, the plurality of slats connected together so as to allow relative pivotal movement of adjacent slats; and an exterior aspect facing outwardly from the base with respect to the bed, the exterior aspect including a decorative feature, the simulated platform bed system being situated about the mattress support such that the system covers at least a portion of the spacing defined between the mattress and the floor surface along each of the first and second side edges and the foot end edge, thereby providing an appearance of a platform bed upon which the mattress appears to be supported, with the system not supporting a weight of the mattress.

2. The simulated platform bed system of claim 1, wherein the base defines a vertical height equal to or greater than the spacing between the mattress and the floor surface such that the system extends into contact with the floor surface when situated about the mattress support.

3. The simulated platform bed system of claim 1, the base including an upper terminal edge extending along the generally U-shape configuration, and the system further comprising:

a flap portion projecting from the upper terminal edge of the base, the flap portion being configured to tuck between the mattress and the mattress support to retain the system in location relative to the bed.

4. The simulated platform bed system of claim 3, the flap portion further comprising:

coupling elements configured to engage with at least one of the mattress or the mattress support so as to secure the flap portion and the system in position.

5. The simulated platform bed system of claim 3, further comprising:

at least one strap member extending between the first and second side edges of the bed to connect the flap portion to itself along the first and second side edges of the bed, thereby further assuring retention of the system in position.

6. The simulated platform bed system of claim 3, wherein the exterior aspect is defined by a fabric layer extending over the base, and the flap portion is at least partially defined by the fabric layer.

7. The simulated platform bed system of claim 1, wherein the exterior aspect further comprises:

a fabric layer having a pattern or coloring defining the decorative feature, the fabric layer bonded to the base along an exterior surface of the base, which faces away from the mattress support.

8. The simulated platform bed system of claim 7, further comprising:

a backing material bonded to the base along an interior surface of the base, which faces towards the mattress support.

9. The simulated platform bed system of claim 8, wherein the backing material comprises a second fabric layer defined by a different material or decorative pattern than the fabric layer of the exterior aspect.

10. The simulated platform bed system of claim 1, the base including a lower terminal edge extending along the generally U-shape configuration, and the system further comprising:

an interior aspect facing inwardly from the base with respect to the bed, the interior aspect including loops connected to the base along the lower terminal edge and stabilizing rods extending through the loops to help maintain the generally U-shape configuration along the first and second side edges and the foot end edge of the bed.

11. The simulated platform bed system of claim 1, further comprising:

an interior aspect facing inwardly from the base with respect to the bed, the interior aspect including fastening elements which directly couple the system to the mattress support.

12. The simulated platform bed system of claim 1, wherein the base is spaced from the floor surface when situated about the mattress support.

13. The simulated platform bed system of claim 1, wherein the base defines a single, continuous piece extending in the generally U-shape configuration.

14. A simulated platform bed system for use with a bed including a mattress and a mattress support configured to support the mattress at a first height above a floor surface, the first height defining a spacing between the mattress and the floor surface, and the system comprising:

a base extending in a generally U-shape configuration along first and second side edges and a foot end edge of the bed, at least a portion of the base being defined by a plurality of slats connected together and oriented vertically such that a vertical height defined by each of the slats is greater than a horizontal width or a thickness defined by each of the slats, the plurality of slats connected together so as to allow relative pivotal movement of adjacent slats; and an exterior aspect facing outwardly from the base with respect to the bed, the exterior aspect including a decorative feature, wherein the base further comprises:

a first corner portion made of a first portion of the plurality of slats, the first corner portion wrapping around a first bed corner defined at a junction of the first side edge and the foot end edge of the bed; and a second corner portion made of a second portion of the plurality of slats, the second corner portion wrapping around a second bed corner defined at a junction of the second side edge and the foot end edge of the bed, the simulated platform bed system being situated about the mattress support such that the system covers at least a portion of the spacing defined between the mattress and the floor surface along each of the first and second side edges and the foot end edge, thereby providing an appearance of a platform bed upon which the mattress appears to be supported, with the system not supporting a weight of the mattress.

15. The simulated platform bed system of claim 14, wherein the first corner portion extends along at least portions of the first side edge and the foot end edge on opposite sides of the first bed corner, and the second corner portion extends along at least portions of the second side edge and the foot end edge on opposite sides of the second bed corner.

16. The simulated platform bed system of claim 14, the base further comprising:

a plurality of unitary panels extending between and coupled to one or both of the first and second corner portions, the plurality of unitary panels extending along the first and second side edges and the foot end edge of the bed.

17. The simulated platform bed system of claim 14, wherein the plurality of slats defines an entirety of the base such that the plurality of slats extends along each of the first and second side edges of the bed, the foot end edge of the bed, and the first and second corner portions.

18. A simulated platform bed, comprising:

a mattress defining first and second side edges and a foot end edge of the bed;

a mattress support sitting on a floor surface, carrying a weight of the mattress and positioning the mattress at a first height above the floor surface, with the first height defining a spacing between the mattress and the floor surface; and a simulated platform bed system positioned around the mattress support in a generally U-shape configuration to provide an appearance of a platform bed upon which the mattress appears to be supported, the system further comprising:

a base extending along the first and second side edges and the foot end edge, at least a portion of the base being defined by a plurality of slats connected together and oriented vertically such that a vertical height defined by each of the slats is greater than both of a horizontal width and a thickness defined by each of the slats, wherein the thickness of each slat is measured along a horizontal direction perpendicular to a direction defining the horizontal width and perpendicular to a direction defining the vertical height, the plurality of slats connected together so as to allow relative pivotal movement of adjacent slats; and an exterior aspect facing outwardly from the base with respect to the mattress support, the exterior aspect including a decorative feature, the simulated platform bed system being situated about the mattress support such that the system covers at least a portion of the spacing defined between the mattress and the floor surface along each of the first and second side edges and the foot end edge.

19. The simulated platform bed of claim 18, wherein the mattress support further comprises:

a box spring configured to support the mattress; and a frame sitting on the floor surface and configured to support the box spring and the mattress.

20. The simulated platform bed of claim 19, the base further comprising:

a first corner portion made of a first portion of the plurality of slats, the first corner portion wrapping around a first bed corner defined at a junction of the first side edge and the foot end edge; and a second corner portion made of a second portion of the plurality of slats, the second corner portion wrapping around a second bed corner defined at a junction of the second side edge and the foot end edge.

21. The simulated platform bed of claim 20, wherein the plurality of slats defines an entirety of the base such that the plurality of slats extends along each of the first and second side edges, the foot end edge, and the first and second corner portions.

* * * * *